US005289952A

United States Patent [19]

Gueret

[11] Patent Number: 5,289,952

[45] Date of Patent: Mar. 1, 1994

[54] DEVICE FOR DISPENSING FOAM, AND PUSH-BUTTON FOR A DEVICE OF THIS KIND

[75] Inventor: Jean-Louis H. Gueret, Paris, France

[73] Assignee: L'Oreal, Paris, France

[21] Appl. No.: 881,755

[22] Filed: Apr. 27, 1992

[30] Foreign Application Priority Data

Apr. 30, 1991 [FR] France ..... 91 05290

[51] Int. Cl.[5] ..... B67D 5/58

[52] U.S. Cl. ..... 222/189; 222/190; 222/209; 222/401; 222/631; 222/633; 239/333; 239/370

[58] Field of Search ..... 222/145, 189, 190, 209, 222/321, 401, 631, 633, 634; 239/343, 333, 370

[56] References Cited

U.S. PATENT DOCUMENTS 3,860,150 1/1975 Maier ..... 222/631
4,057,176 11/1977 Horvath .
4,179,049 12/1979 Umstead .
4,214,677 7/1980 Bauer et al. ..... 222/631 X
4,880,161 11/1989 Wright ..... 239/343 X
4,957,218 9/1990 Ford, Jr. ..... 222/190 X

FOREIGN PATENT DOCUMENTS 0392238 10/1990 European Pat. Off. .
2317969 7/1976 France .

*Primary Examiner*—Huson Gregory L.
*Attorney, Agent, or Firm*—Cushman, Darby & Cushman

[57] ABSTRACT

The device comprises a pump (10) for delivering a liquid with a foaming agent from a container (R). The displacement of a rigid push-button (14) causes a variation in the volume of an annular chamber (13), and a return air inlet valve (22) allows for the inflow of air into this chamber. The end of the container (R) provided with the pump (10) is closed by a head (5) having a base (7) recessed with respect to the end of a central sleeve (8) carrying the pump and partly delimiting the said annular chamber (13), while the push-button (14) has in its base a collar (17) capable of closing the annular chamber (13) and compressing the air contained therein.

24 Claims, 5 Drawing Sheets

DEVICE FOR DISPENSING FOAM, AND PUSH-BUTTON FOR A DEVICE OF THIS KIND

FIELD OF THE INVENTION

The invention relates to a device for dispensing foam from a container containing a liquid with a foaming agent, and capable of mixing the liquid emerging from the container with air.

More precisely, the devices for dispensing foam according to the invention are of the type comprising:

- a pump means provided at one end of the container for delivering the liquid,
- a porous component situated downstream of the pump means and disposed in a discharge channel,
- an expansion chamber situated downstream of the porous component,
- air compression means for directing pressurised air to the porous component in order to mix it with the liquid and to form foam, and
- an air inlet valve provided to allow for the inflow of air to the porous component and to prevent the return thereof, this device moreover comprising a rigid push-button mounted on the said end of the container, an annular chamber formed around the pump means and delimited by the push-button, which, upon the displacement thereof, causes a variation in the volume of this annular chamber, and at least one return air inlet valve to allow for the inflow of air into this annular chamber, the whole assembly being such that when the push-button is pressed, the pump is actuated while the air of the annular chamber is compressed and directed towards the porous component.

DESCRIPTION OF THE PRIOR ART

A device of this kind is described in EP-A-0 392 238. The dispenser of this document is complicated as it includes a large number of components and moreover it is bulky, particularly in the axial direction of the container.

SUMMARY OF THE INVENTION

The aim of the invention is above all to provide a dispenser of the type defined hereinbefore which no longer has, or has to a lesser extent, the disadvantages mentioned hereinabove. The invention aims in particular to provide a compact dispenser having a simplified construction only requiring a small number of components.

According to the invention, the device for dispensing foam from a container containing a liquid with a foaming agent and capable of mixing the liquid emerging from the container with air of the type defined hereinbefore is characterised in that the end of the container provided with the pump means is closed by a head having a base recessed in the axial direction of the container with respect to the end of a central sleeve carrying the pump means and partly delimiting the said annular chamber, while the push-button has on its base a collar forming a plate capable of closing the said annular chamber and compressing the air in this chamber when the push-button is pressed, the central part of the push-button having a smaller diameter than that of the collar and having a cylindrical cavity covering the pump means and communicating with the said chamber.

The push-button advantageously rests mechanically against a rod controlling the pump means, which is actuated mechanically by the push-button when the latter is pressed.

The push-button is advantageously formed by a seating and a cap fixed to one another.

The seating is traversed by a passage for the liquid and at least one passage for the compressed air and has on its upper face grooves departing from the ends of the said passages and directed towards the porous component.

The groove for the liquid is preferably disposed along the axis of the discharge channel, while the groove or grooves intended for the compressed air are situated on either side or on only one side of the groove for the liquid. As a variant, the groove for the liquid is disposed perpendicularly to the axis of the discharge channel. The grooves for the compressed air may be parallel to the groove for the liquid or may converge towards the porous component.

The grooves for the liquid and for the compressed air may remain separate from one another and may end at the porous component where the liquid and air are mixed.

The air grooves may arrive at the porous component in parallel with or perpendicularly to the direction of the inflow of the liquid to this porous component.

According to another possibility, the groove for the liquid opens into the air groove or grooves upstream of the porous component. An anti-splash plug may be provided at the end of the liquid groove directed towards the porous component.

It may also be provided that the grooves for the liquid and for the compressed air open into a mixing channel upstream of the porous component, wherein the said mixing channel may have a shape adapted to increase turbulence.

A ring of flexible porous material, especially of elastomer foam, may be provided in the said annular chamber.

The cylindrical wall of this annular chamber may be provided entirely on the head closing the end of the container. In this case, the collar of the push-button is capable of sliding like a piston in the interior of this cylindrical wall.

As a variant, the lateral cylindrical wall of the annular chamber is only partly formed by the lateral wall of the head. In this case, the collar of the push-button is provided on its outer periphery with a cylindrical skirt cooperating with the said wall of the head in order to define the annular chamber. The skirt of the push-button preferably surrounds the lateral wall of the head closing the end of the container in a sealed manner.

According to another variant, the lateral wall of the annular chamber is formed by deformable bellows cooperating with the collar of the push-button at one side and connected to the container at the other side.

In general, the container comprises a rigid wall. It may be provided with a pump without a return air inlet, in which case a flexible pouch containing the liquid product may be provided in the interior of the container, the aforesaid pump being mounted on this pouch.

According to another possibility, if the container is provided with a pump without a return air inlet, the chamber of the container containing the foaming liquid product is delimited by the rigid lateral cylindrical wall of this container and by a piston which forms the base of the chamber and can slide in a sealed manner as the product is dispensed.

The air inlet valve provided in the push-button is advantageously formed by a flexible component, the edge of which is held between the seating and the cap of the push-button, this flexible component having at least one boss with its convexity directed towards the container, capable of closing the outlet of an air passage, the flexible component extending as far as the end of a discharge nozzle of the push-button. The flexible component may be adapted so that it also ensures the closure of the nozzle, downstream of the porous component.

The flexible component closes the grooves provided in the seating towards the top.

The push-button advantageously consists of two complimentary components fitted one into the other and confining between them the flexible component, one of the components being the cap which carries the discharge channel, the axis of which is parallel to that of the rod.

As a variant, the flexible component extends around the seating forming the other component of the push-button, until it is at right angles with the holes of the collar of the seating in order to form non-return means for the return air inlet valve (or valves).

A screen may be placed on the porous component in contact with the outlet orifice for the foam, in order to obtain a foam having a more homogeneous density.

The invention also relates to a push-button for a device such as the one defined hereinbefore.

BRIEF DESCRIPTION OF THE DRAWINGS

In addition to the arrangements described hereinabove, the invention also consists of a number of other arrangements which will described in more detail hereinafter by way of non-limiting embodiments described with reference to the accompanying drawings, in which.

Figure 1:
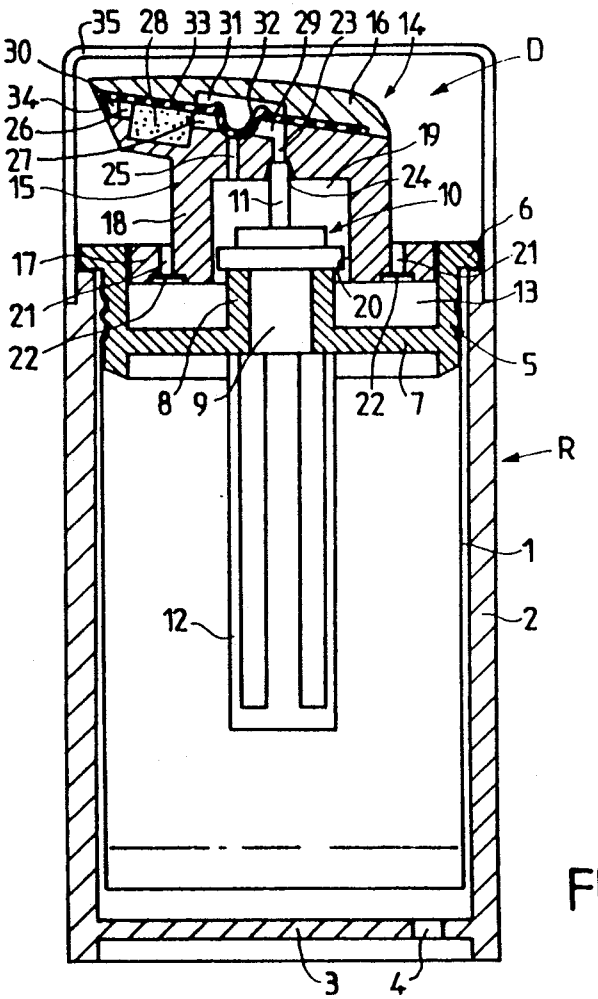
FIG. 1 is a vertical section, along the line I—I of FIG. *2a*, of a container provided with a dispenser according to the invention.
Figure 3:
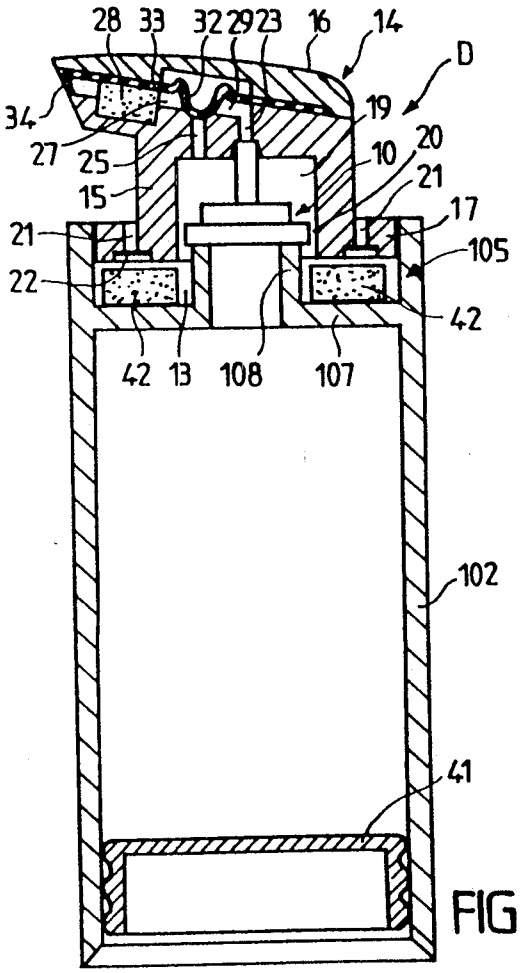
Figure 4:
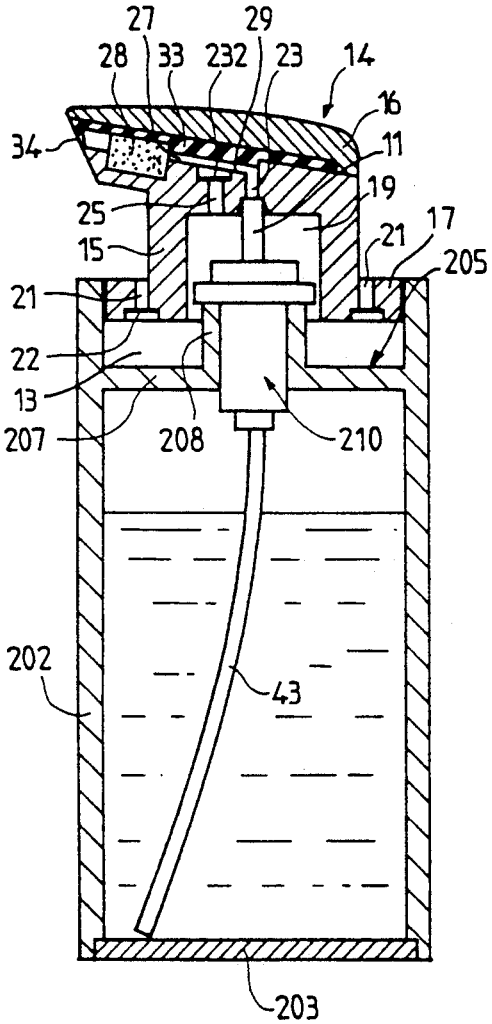
Figure 5:
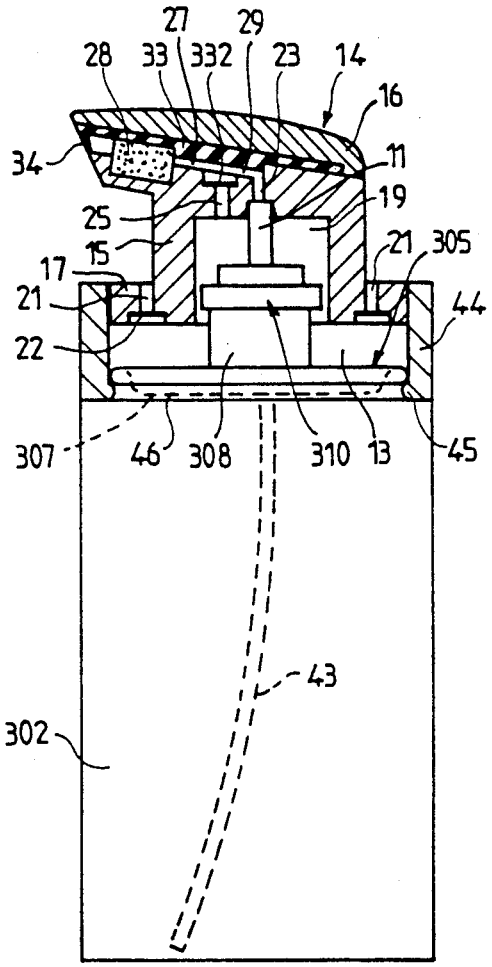
Figure 6:
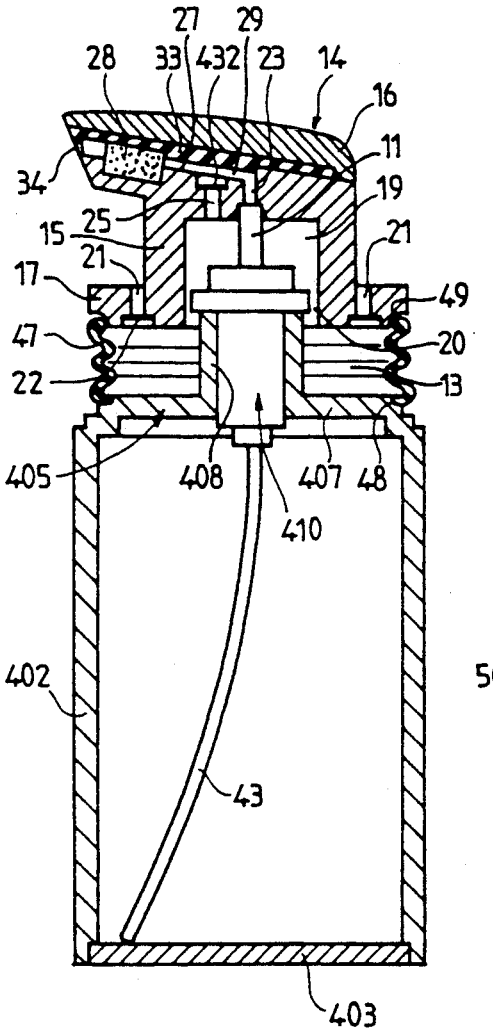
Figure 7:
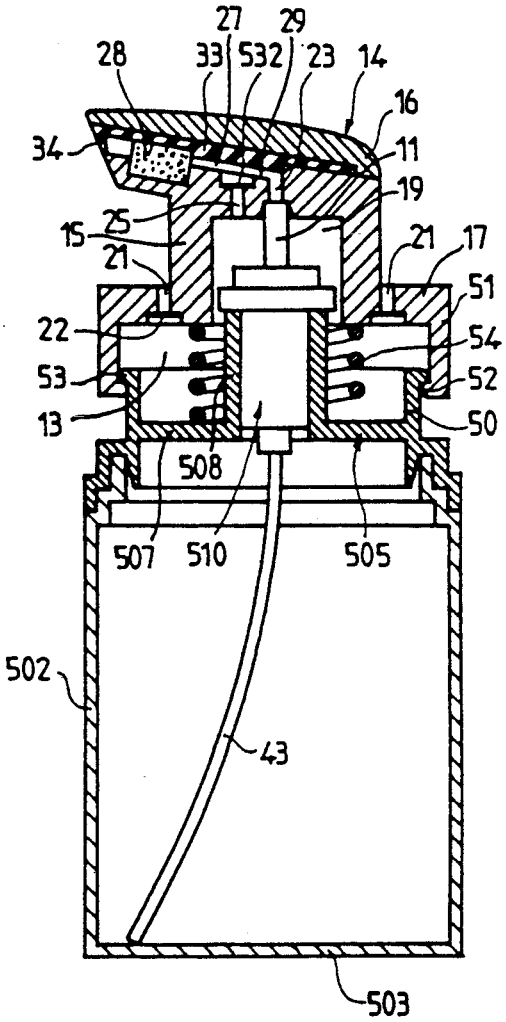
Figure 9:
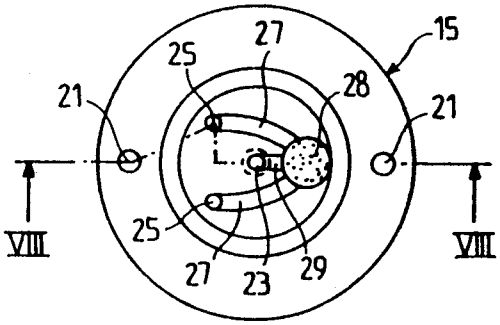
Figure 10:
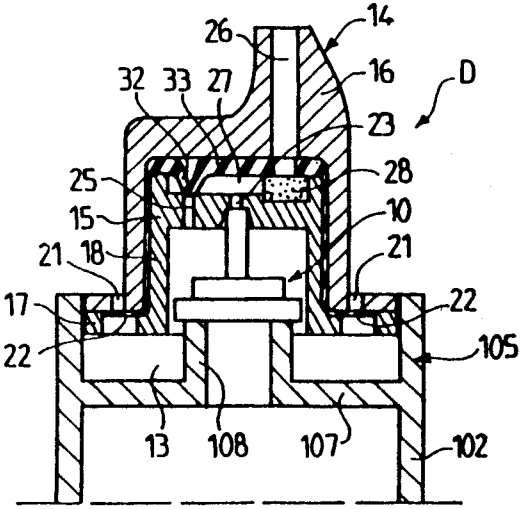
Figure 8:
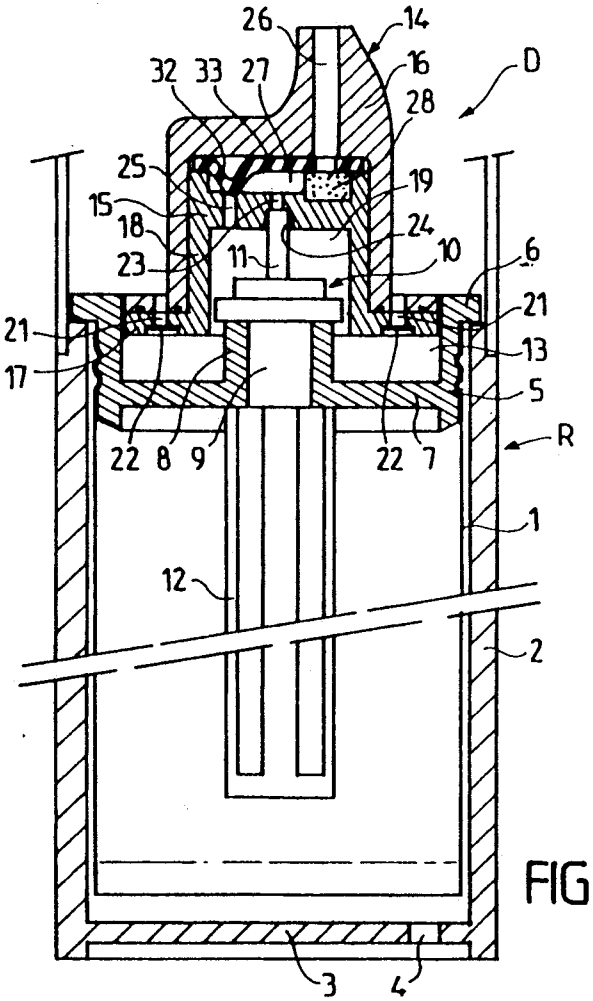

FIG. *2a* is a section of the push-button of FIG. 1, showing the air and liquid inlet passages and the porous component;

FIG. *2b* is a section of a variant embodiment of the push-button;

FIGS. *2c* to *2f* are sections of other variants embodiments of the push-button;

FIG. *2g* is a section of a flexible component forming an air inlet valve;

FIG. 3 is an axial vertical section of a container, the base of which is formed by a movable piston, provided with a dispenser according to the invention, with a pump without a return air inlet;

FIG. 4 is a vertical axial section of a dispenser provided on a container provided with a return air inlet pump with a dip tube;

FIG. 5 is a partial section of a variant embodiment of FIG. 4;

FIG. 6 is an axial vertical section of a device in which deformable bellows define the annular chamber;

FIG. 7 is a vertical axial section of a variant in which the annular chamber is partly defined by a cylindrical skirt provided on the lower part of the push-button;

FIG. 8 is a vertical section, along the line VIII—VIII of FIG. 9, of a container analogous to that of FIG. 1, provided with a dispenser according to the invention, adapted to a push-button, the axis of the discharge channel of which is vertical;

FIG. 9 is a top view of the seating 15 of the push-button of FIG. 8, showing the air and liquid inlet passages and the porous component, and FIG. 10 is a partial section analogous to FIG. 3, showing a variant of the flexible component fitted to a container of the type shown in FIG. 3, but the axis of the discharge channel of which is vertical.

DETAILED DESCRIPTION OF THE INVENTION

Referring to FIG. 1 of the drawings, it shows a device D for dispensing foam from a container R comprising an air-free flexible pouch 1 containing a liquid with a foaming agent. The pouch 1 is placed in a rigid cylindrical casing 2 having a base 3 in which an opening 4 is provided for the inflow of air. The pouch 1 is closed in its upper part by a dish-shaped head 5 with its concavity directed towards the side opposite the base 3. The upper edge of the flexible pouch 1 is held in a sealed manner against the cylindrical wall of the head 5 engaged in the pouch 1. The head 5 is provided with an upper rim 6 projecting radially towards the exterior, coming to rest against the upper end of the casing 2.

The head 5 has a base 7 provided in its central part with a sleeve 8 projecting from the side opposite the pouch 1. The body 9 of a hand pump 10 forming a pump means for the liquid contained in the pouch 1 is fixedly mounted in this sleeve 8. A hollow rod 11 projects axially from the pump body 9 on the side opposite the pouch 1. This rod 11 is subjected to elastic return. Pumping is ensured when the rod 11 is pressed into the pump body 9. The pump 10 is a pump without a return air inlet. It is crimped, snapped or screwed on to the sleeve 8.

An anti-fixing device 12, e.g. formed by a flexible perforated shaft or by a type of grill, extending from the head 5 towards the base of the pouch 1 is provided in order to prevent the walls of this pouch from sticking to one another as a result of atmospheric pressure as the liquid is pumped.

An annular chamber 13 is formed in the head 5 between the outer surface of the sleeve 8 and the inner surface of the wall of the head 5.

A rigid push-button 14 is provided above the head 5. This push-button 14 is formed by a seating 15 and a cap 16 fixed to one another, inter alia by gluing, welding or snap engagement.

The push-button 14 has in its base a collar 17 forming a plate capable of compressing the air in the annular chamber 13. In the case of FIG. 1, the collar 17 slides like a piston in a substantially sealed manner against the inner surface of the peripheral wall of the head 5. The central part 18 of the seating 15 of the push-button has a smaller outer diameter than that of the collar 17. This part 18 has a cylindrical cavity 19 coaxial with the sleeve 8 covering the rod 11 and the upper part of the pump body. The inner cylindrical wall of the cavity 19 has a larger diameter than the maximum diameter of the pump body 9 so that there is a space 20 for establishing communication between the chamber 13 and the cavity 19.

The collar 17 is traversed by holes 21 provided on the side of the chamber 13 with return air inlet valves 22 to allow for the inflow of air from the exterior into the chamber 13, but preventing the discharge thereof. The upper wall of the seating 15 has in the centre an axial passage 23 opening via a truncated flared orifice 24 on the side of the pump 10. The upper end of the rod 11 comes to rest in a virtually sealed manner against this orifice 24.

At least one other passage 25 parallel to the passage 23 traverses the upper wall of the seating 15 parallel to the axis of the rod 11, but offset radially towards the exterior relative to this axis.

Figure 2A:
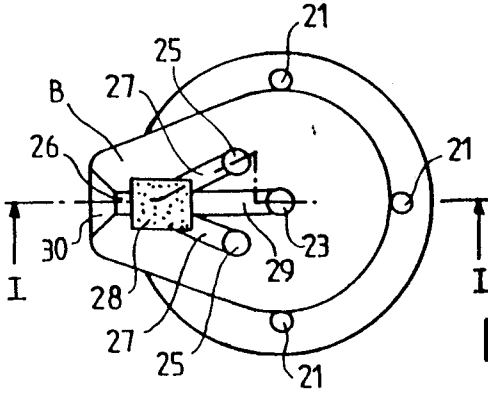

When the seating 15 is adapted as shown in FIG. 2*a*, two passages 25 are provided on either side of the vertical plane passing through the axis of the discharge channel 26 for the foam. Two grooves 27 departing from the upper end of the passages 25 and converging towards one another in the direction of a cavity containing a porous component 28 are provided on the upper face of the seating 15. Another groove 29 extending along the axis of the channel 26 and forming a bisector of the grooves 27 is provided between the upper end of the passage 23 and the cavity containing the porous component 28.

The ends downstream of the channels 27 and 29 are in contact with the porous component 28 where the air and liquid are mixed. Upstream of the component 28, the channels 27 and 29 are separated from one another.

The porous component 28 may be, e.g. a polyethylene frit, a metal or ceramic frit, an open-cell foam, a grill, glass fibre, a felt, a nest formed by a multitude of obstructions or any other porous material.

The offset section of FIG. 2*a* could give the false impression in FIG. 1 that the grooves 27 and 29 are in communication. They are not as they are situated in offset planes. This comment also applies to FIGS. 3 to 7.

As can be seen in FIG. 2*a*, the seating 15, in plan view, is defined on the side opposite the outlet for the product by a semi-circular contour and on the side of the outlet for the product, by a trapezoidal contour, the small base of which forms a nozzle B for the discharge of the foam. An expansion chamber 30 situated in front of the porous component 28 and the section of which increases in the direction of discharge is provided at the front end of the nozzle B.

The cover 16 has a cavity 31 in the region situated above each passage 25, forming a housing for receiving an air inlet valve 32.

The valve 32 is advantageously formed for each passage 25 by a rounded boss with its convexity directed towards the passage 25 provided in a flexible component 33, preferably of an elastomeric material, of generally flat shape and the edge of which is held between the seating 15 and the cover 16. The flexible component passes above the porous component 28 and ends in a lip 34 inclined towards the bottom, capable of closing the outlet of the expansion chamber 30. The component 33 closes the grooves 27 and 29 towards the top and defines together with these grooves the air and liquid inlet channels.

The valve 32 allows for the displacement of air from the passage 25 towards the porous component 28 and prevents displacement in the opposite direction. This prevents liquid from being sucked towards the chamber 19. A cap 35 is provided to cover the push-button 14 during storage, this cap 35 fitting on to the upper end of the casing 2.

This being the case, the dispenser of FIG. 1 operates as follows.

In order to dispense a measure of foam, the user removes the cap 35 and presses the push-button 14.

Consequently, the rod 11 of the pump 9 without a return air inlet is depressed, thereby effecting delivery of the product contained in the pouch 1 through the passage 23 and the groove 29 in the direction of the porous component 28. At the same time, the collar 17 pressed into the annular chamber 13 compresses the air confined in this chamber. The pressurised air is discharged via the passages 25, thereby opening the valves 32 and resulting in a flow of air via the grooves 27 in the direction of the porous component 28. Air and liquid are mixed at this porous component and the mixture of foaming liquid and air can be expanded in the chamber 30. The foam emerges from the nozzle B, raising the lip 34.

The dispenser of FIG. 1 is a dispenser without a return air inlet, i.e. an aseptic dispenser.

Figure 2B:
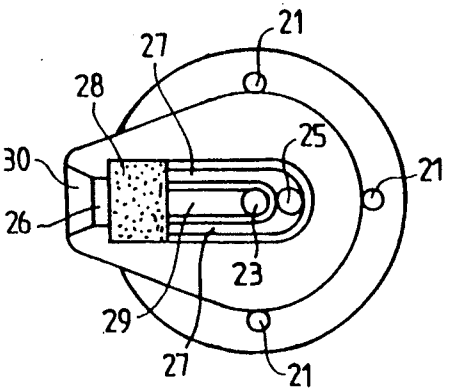

In the variant embodiment of FIG. 2*b*, one single passage 25 having its axis situated in the vertical plane passing through the axis of the discharge channel 26 is provided in the seating 15 to the rear of the passage 23. The groove 27 departing from the passage 25 is in the shape of a hairpin surrounding the groove 29 and ends against the porous component 28. The groove 29 for the liquid ends at the porous component 28, as in the case of FIG. 2*a*. According to this variant, the air and liquid arrive at the porous component 28 in parallel directions.

Figure 2D:
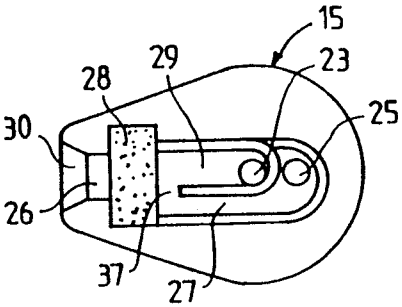
Figure 2C:
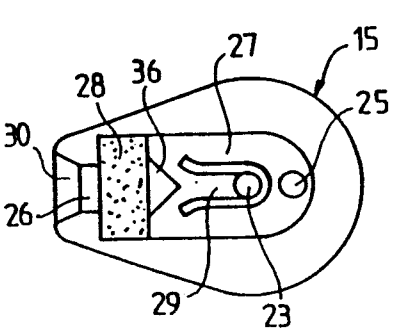

FIG. 2*c* shows a variant embodiment of the seating 15 with an arrangement of the passages 23 and 25 identical to that of FIG. 2*b*. However, the liquid groove 29 does not end directly against the porous element 28, but opens into the branches of the air groove 27 upstream of this element 28 at an anti-splash plug 36 capable of bursting and slowing down the liquid flow. This flow is therefore separated into two parts which are mixed respectively with the air arriving in each branch of the hairpin groove 27, and then penetrates into the porous element 28.

FIG. 2*d* shows a variant of the seating in which the groove 29 for the liquid ends at the porous component 28 while communicating just in front of this component 28 by means of a lateral passage 37 with a single branch of the groove 27 parallel to the groove 29.

Figure 2F:
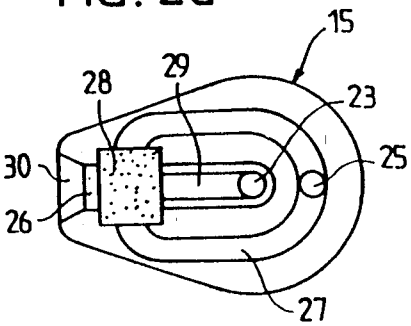
Figure 2E:
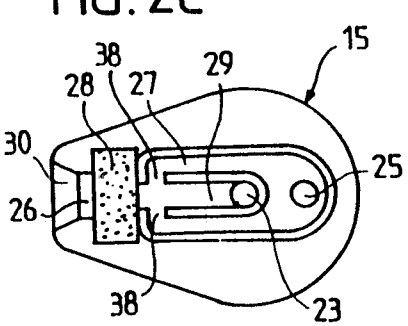

FIG. 2*e* shows a variant embodiment of the seating 15 in which the groove 27 having two hairpin-shaped branches for the pressurised air communicates upstream of the porous component 28 via lateral openings 38 with the groove 29 for the liquid. The air therefore arrives substantially perpendicularly in the flow of liquid upstream of the porous component 28.

FIG. 2*f* shows another variant embodiment of the seating 15 of the push-button. The two branches of the groove 27 depart form the end of the air passage 25 forming a sort of pliers arrangement, the ends of which come into contact with the transverse faces of the porous component 28 so that the air arrives at this porous component in a direction perpendicular to the inflow of liquid via the groove 29, the axis of which coincides with the axis of the discharge channel 26. The air and liquid are mixed in the porous component 28 when the two flows of air and liquid directed perpendicularly to one another meet.

It is clear that different arrangements are possible for the liquid and air passages 23 and 25 respectively. The liquid passage 23 may be situated in front of, to the rear of or level with the air passage 25, in the axial direction of the discharge channel 26.

Figure 2G:
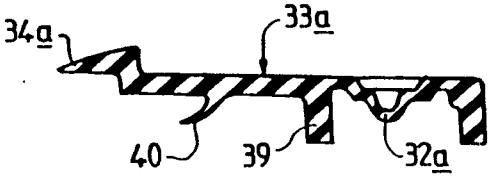

FIG. 2*g* shows a variant embodiment of the flexible component 33*a* of elastomeric material. The boss forming the air inlet valve 32*a* is situated upstream, in the direction of the flow of fluid, of a wall 39 delimiting the liquid outlet on the side opposite the valve 32*a*. A tongue 40 is provided to form a non-return seal in each air groove such as 27.

The flexible component 33*a* of FIG. 2*g* is adapted to a push-button in which the foam is discharged in an upward direction. The lip 34*a* is consequently provided.

The flexible material of the component 33, 33*a* is preferably a natural or synthetic elastomer. Examples of elastomers that can be used are styrene-butadiene copolymers, nitrile rubbers, polychloroprene or neoprene, EPDM rubber, polyurethanes, silicone rubber and ethylene vinyl acetate copolymers.

The optional lip 34, 34*a* is in sealed contact with the seating 15 when no dispensing is taking place and moves away from the seating by deflection by the force of the product to be dispensed. The lip returns by means of elastic force into sealed contact with the seating 15 when dispensing ceases.

The flexible component 33, 33*a* is mounted on the seating by snapping, welding or gluing, or may be held with the aid of the rigid cap 16.

It could also be envisaged to place a poppet valve (or any other type of valve) in the air inlet passage 25, as illustrated in FIGS. 4 to 7, replacing the valve 32 or in combination with this valve.

In addition to the air and liquid inlet grooves 27 and 29, any type of baffles or systems, such as labyrinths, may be provided for creating vortices in order to premix the air and the liquid, in particular before their passage through the porous component 28.

As a result of the fact that the pump 10 is of the type without a return air inlet, and the pouch 1 containing the product is air-free, it is possible to store the dispenser upside down, and also to dispense the foam upside down.

Referring to FIG. 3, it shows a variant embodiment of the dispenser D in which the rigid outer casing 102 forms the container itself and contains the air-free product, the flexible pouch 1 having been eliminated. The head 105 forms an integral part of this casing 102, the base 107 still being recessed in the axial direction with respect to the upper end of the central sleeve 108. The base of the casing 102 is open and a piston 41 is provided to slide in a sealed manner in the interior of the said casing as the volume of the liquid contained in this casing reduces subsequent to pumping. The pump 10 is again a pump without a return air inlet.

A ring 42 of flexible porous material, especially of elastic foam, is provided in the annular chamber 13. This ring 42 is compressed when the push-button 14 is pressed.

The other elements of the device of FIG. 3 identical to elements already described with reference to FIG. 1 are designated by the same reference numerals and are not described again.

The operation of this device is identical to that described with reference to FIG. 1. The piston 41 gradually rises in the casing 102 as the liquid contained in this casing is pumped out. The ring 42 of flexible porous material makes it possible, by virtue of its own volume, to adjust by reduction the volume of compressed air delivered via the passage 25 when the button 14 is pressed.

The volume of air delivered each time the push-button is pressed may be modified by the addition of rings of elastic foam of different densities.

FIG. 4 of the drawings shows a device according to the invention combined with a return air inlet pump 210 mounted on a container 202 having rigid walls containing the liquid and air. The base 203 of the container 202 is fixed and rigid. The upper part forms a head 205 similar to the one described with reference to FIG. 3 having a central sleeve 208 and a recessed base 207. The return air inlet pump 210 is provided with a dip tube 43.

The air passage or each air passage 25 is provided with a non-return valve 232, so that the flexible component 33 does not have a boss similar to the boss 32 of FIG. 1.

The other elements of the device of FIG. 4 identical to elements already described with reference to FIG. 1 are designated by the same reference numerals and are not described again.

The operation of this device is similar to that described with reference to FIG. 1. However, as a result of the fact that the pump 210 is of the type having a return air inlet with a dip tube 43, this device must be used with the push-button 14 at the top, that is, with the dip tube 43 in the liquid.

FIG. 5 shows a variant embodiment in which the push-button 14 is combined with a skirt 44 in which it may slide and is provided in the lower part of its inner surface with a snap flange 45 capable of cooperating with a recess 46 provided in the upper part of a container 302 provided with a pump 310 having a return air inlet and a dip tube 43.

The air passage 25 is provided with a non-return valve 332, while the flexible component 33 does not have a boss.

The pump 310 is mounted in a central sleeve 308 projecting over the base wall 307 of the upper end or head 305 of the container.

The skirt 44 forms a sort of adapter capable of creating the cylindrical wall of the annular chamber 13 in combination with the base 307 of the upper part of the container 302.

The push-button 14 can thus be adapted to an existing container, as illustrated in FIG. 5.

The operation is identical to that of the device of FIG. 4 and must be effected with the push-button at the top.

FIG. 6 shows a variant embodiment of the dispenser. The head 405 which forms an integral part of the container 402, the base 403 of which is fixed, still has in its centre a sleeve 408 projecting from the side opposite the container. A return air inlet pump 410 with a dip tube 43 is mounted in the sleeve 408. The head 405 does not have a cylindrical peripheral wall along its base 407. Deformable concertina bellows 47 cover the edge of the base 407 of the head. The lower edge of these bellows 47 is e.g. engaged in a sealed manner in a peripheral groove 48 provided along the base 407.

The upper edge of the bellows 47 rests in a recess 49 provided in the lower part of the collar 17 of the push-button 14.

The annular chamber 13 is thus delimited laterally by these bellows 47.

In the embodiment of FIG. 6, the collar 17 of the seating 15 is provided with the return air inlet valves 22 described hereinbefore. The bellows 47 may simply rest in the recess 49 so that sealing is established between the wall of this recess and the bellows 47 when the push-button 14 is pressed. On the other hand, when this push-button 14 rises again by elastic force there is no longer sealed contact between the upper edge of the bellows 47 and the wall of the recess 49. Air can therefore flow between this recess wall and the bellows 47 into the chamber 13 when the push-button 14 rises again. The passages 21 and the valves 22 can thus be eliminated, air return being ensured by the leakage between the recess 49 and the bellows 47 when pressure on the push-button 14 ceases.

The air passage 25 is provided with a non-return valve 432.

The other elements of the device of FIG. 6 identical or similar to elements already described with reference to the preceding figures are designated by the same reference numerals and are not described again.

The operation of the device of FIG. 6 is similar to that already described hereinbefore. As a result of the fact that that pump 410 is of the type having a return air inlet with a dip tube 43, the device must be used in an upright position.

FIG. 7 shows a variant embodiment in which the head 505 connected to the upper end of the container 502 has a cylindrical lateral wall 50, the length of which in the axial direction of the central sleeve 508 is less than the length of this sleeve. This cylindrical wall 50 only partly defines the annular chamber 13.

The base 17 of the push-button is provided on its periphery with a cylindrical skirt 51 extending towards the bottom, surrounding the wall 50 and capable of sliding in a sealed manner against this wall. The skirt 51 preferably has an inner flange 52 in its lower part, while the wall 50 has an outer flange 53 at its upper end. The cooperation of the flanges 52, 53 ensures that the skirt 51 is held towards the top relative to the wall 50.

A return spring 54 is provided around the sleeve 508 between the base 507 of the head 505 and the seating 15 of the push-button.

It should be noted that a return spring of this kind could also be provided in the embodiments described hereinbefore, as a complement to the return spring provided in the pump and acting on the rod 11.

The operation of the device of FIG. 7 is similar to that of the devices described hereinbefore.

Referring to FIG. 8, there is shown a variant embodiment of the dispenser D adapted to a push-button 14 the axis of the discharge channel 26 of which is parallel to the axis of the container R, analogous to that of FIG. 1. The push-button 14 is made of two complementary components, fitted one into the other and confining between them the flexible component 33 in which the valve 32 is formed. More precisely, one of the two components forming the push-button is the cap 16 in which the discharge channel 26 is formed, the cap 16 covering the other component, the seating 15, the central part 18 of which has the cylindrical cavity 19 having the same axis as the sleeve 8, covering the rod 11 and the upper part of the pump body. As before, the collar 17 of the seating is traversed by holes 21 provided with return air inlet valves 22. The holes 21 are opposite holes also provided in a complementary collar provided on the cap 16. The two said collars also serve for the assembly, e.g. by gluing, of the two components 15 and 16 forming the push button. FIG. 9 shows the arrangement of the hollow grooves 27 and 29 in the upper part of the seating 15 and the porous component 28.

The operation of this device is identical to that described with reference to FIG. 1.

FIG. 10 shows a variant of the flexible component fitted to a container of the type shown in FIG. 3, although the axis of the discharge channel thereof is again vertical, as in FIG. 8. The push-button is analogous to the push-button of the variant of FIG. 8, but here the flexible component 33 extends all around the seating 15 and covers its central part 18 and its collar 17. By virtue of this arrangement, the flexible component of the return air inlet valves 22 is formed by a portion of the flexible component 33.

The operation of this device is identical to that described with reference to FIG. 3.

By virtue of the device of the invention, it is possible to mix the liquid and air in a ratio of liquid to air volume of between 10/90 and 50/50.

This device is compact and flush at the push-button.

I claim:

1. A device for dispensing foam from a container containing a liquid with a foaming agent and capable of mixing the liquid emerging from the container with air, comprising:

pump means disposed at one end of the container for delivering the liquid from the container, a rigid push button mounted on the one end of the container for movement toward and away from the one end of the container said push button having a discharge channel including an outlet and a porous component disposed in said discharge channel upstream of said outlet, an expansion chamber located downstream of said porous component, said push button including air compression means and duct means for delivering compressed air to said discharge channel, said push button including valve means for controlling delivery of air from said duct means to said discharge channel upon actuation of said push button, said air compression means including an annular chamber in said push button and surrounding said pump means, the volume of said annular chamber being variable upon movement of said push button from a deactuated to an actuated position corresponding to movement thereof toward the one end of the container, said push button including a one way valve allowing introduction of air into said annular chamber upon movement of said push button away from the one end of the container, said push button being operatively connected to said pump means so that, upon movement of said push button toward the one end of the container, said pump means delivers liquid to said discharge channel while air in said annular chamber is compressed and delivered through said valve means to said discharge channel and then to said porous component, said annular chamber including a head closing the one end of the container and having a sleeve carrying said pump means, said push button including a collar defining a portion of said annular chamber, said collar surrounding a cavity in said push button receiving said pump means and said sleeve when said push button is moved toward the one end of the container, said cavity being in communication with said annular chamber.

2. Device according to claim 1, characterised in that a ring (42) of flexible porous material is disposed in the said annular chamber (13).

3. The invention as claimed in claim 1 wherein said porous component includes means for creating vortices to mix the liquid and the air.

4. The invention as claimed in claim 1 wherein said push button comprises a first member including said cavity and a second member comprising a cap secured to said first member, said first member including a passage for delivering the liquid to said discharge channel, said first member including an upper face having one groove formed therein establishing communication between said duct means and said porous component and another groove defining a portion of said discharge channel, said push button including a flexible component extending around a portion of said first member and said upper face, said flexible component including a portion overlying said one way valve.

5. The invention as claimed in claim 1 wherein said annular chamber of said push button includes a cylindrical wall, said push button including a head closing the one end of the container with said head being defined in part by said cylindrical wall of said push button, said push button further including a collar disposed to slide along said cylindrical wall of said annular chamber.

6. The invention as claimed in claim 1 wherein said annular chamber of said push button includes a cylindrical peripheral skirt, said push button including a head closing the one end of the container, said head having a peripheral wall slidably received in said peripheral skirt to define a portion of said annular chamber.

7. The invention as claimed in claim 1 wherein said push button includes a collar and said annular chamber has a peripheral wall in the form of a bellows extending between said collar and the one end of the container.

8. The invention as claimed in claim 1 wherein the container includes a rigid wall, said pump means is a valveless pump, said container including a flexible pouch therein, said pump being connected to said pouch.

9. The invention as claimed in claim 1 wherein the container includes a rigid wall, said pump means is a valveless pump, said container containing the liquid product, said container including a piston forming the base of the container and slidable along said rigid wall as the product is dispensed.

10. The invention as claimed in claim 1 wherein said push button comprises a seating member and a cap, said seating member including a passage for delivering the liquid to said discharge channel, said seating member including an upper face having one groove formed therein establishing communication between said duct means and said porous component and another groove for the liquid defining a portion of said discharge channel, said push button having a flexible component disposed on said upper face and covering said grooves, said cap being secured on said upper face.

11. The invention as claimed in claim 10 wherein said flexible component is secured to said upper face between said upper face and said cap.

12. The invention as claimed in claim 10 wherein said discharge channel is disposed in said cap and has an axis, said pump means including a rod having an axis extending parallel to said axis of said discharge channel.

13. The invention as claimed in claim 10 wherein said valve means comprises a protrusion on said flexible component extending to close said duct means.

14. The invention as claimed in claim 10 or 13 wherein said flexible component extends to said outlet of said push button and includes a portion flexibly closing said outlet.

15. The invention as claimed in claim 1 wherein said pump means includes an actuating rod engaging said push button so that said rod acutates said pump means when said push button is moved toward the one end of the container corresponding to said actuated position.

16. The invention as claimed in claim 1 or 15 wherein said push button comprises a first member including said cavity and a second member comprising a cap secured to said first member, said first member including a passage for delivering the liquid to said discharge channel, said first member including an upper face having one groove formed therein establishing communication between said duct means and said porous component and another groove defining a portion of said discharge channel.

17. The invention as claimed in claim 16 wherein said one groove is located on one side of another groove.

18. The invention as claimed in claim 16 wherein said another groove includes a portion that extends perpendicularly to said discharge channel and said one groove extends on one side of said another groove.

19. The invention as claimed in claim 16 wherein said another groove includes a portion that extends perpendicularly to said discharge channel and said one groove extends on one side of said another groove and a third groove connected to said duct means extends on the opposite side of said another groove.

20. Device according to claim 19, characterised in that the grooves (27) for the compressed air converge towards the porous component.

21. Device according to claim 19, characterised in that the grooves (27) for the compressed air arrive at the porous component (28) in parallel with the direction of the inflow of the liquid to this porous component.

22. Device according to claims 19, characterised in that the grooves (27) for the compressed air arrive at the porous component (28) perpendicularly to the direction of the inflow of the liquid to this porous component.

23. Device according to claim 19, characterised in that the groove (29) for the liquid opens into the groove or grooves (27) for the compressed air upstream of the porous component (28).

24. Device according to claim 23, characterised in that an antisplash plug (36) is provided, at the end of said another groove (29) directed towards the porous component (28).

* * * * *